US009150294B2

(12) United States Patent
Ito et al.

(10) Patent No.: US 9,150,294 B2
(45) Date of Patent: Oct. 6, 2015

(54) OUTBOARD MOTOR CONTROL SYSTEM

(75) Inventors: Makoto Ito, Shizuoka (JP); Katsutoshi Naito, Shizuoka (JP); Yoshikazu Nakayasu, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 14/368,807

(22) PCT Filed: May 9, 2012

(86) PCT No.: PCT/JP2012/061867
§ 371 (c)(1),
(2), (4) Date: Jun. 26, 2014

(87) PCT Pub. No.: WO2013/118316
PCT Pub. Date: Aug. 15, 2013

(65) Prior Publication Data

US 2014/0364019 A1 Dec. 11, 2014

(30) Foreign Application Priority Data

Feb. 10, 2012 (JP) ..... 2012-027329

(51) Int. Cl.

| | |
|---|---|
| ***B63H 21/22*** | (2006.01) |
| ***B63H 5/08*** | (2006.01) |
| ***B63H 21/21*** | (2006.01) |
| ***B63H 20/12*** | (2006.01) |
| *B63H 25/02* | (2006.01) |

(52) U.S. Cl.
CPC ..... *B63H 5/08* (2013.01); *B63H 20/12* (2013.01); *B63H 21/21* (2013.01); *B63H 25/02* (2013.01)

(58) Field of Classification Search
USPC ..... 440/1
IPC ..... B63H 5/08,21/21, 20/12
See application file for complete search history.

(56) References Cited

U.S. PATENT DOCUMENTS

| | | | | |
|---|---|---|---|---|
| 7,931,511 | B2 * | 4/2011 | Suzuki et al. | 440/1 |
| 2006/0166567 | A1 | 7/2006 | Otobe et al. | |
| 2007/0049136 | A1 * | 3/2007 | Bremsjo | 440/1 |
| 2007/0207683 | A1 | 9/2007 | Mizutani | |
| 2010/0191397 | A1 | 7/2010 | Nose et al. | |
| 2011/0010028 | A1 | 1/2011 | Mizutani et al. | |
| 2011/0217886 | A1 * | 9/2011 | Kuriyagawa et al. | 440/1 |
| 2011/0294370 | A1 * | 12/2011 | Kuriyagawa et al. | 440/1 |

FOREIGN PATENT DOCUMENTS

| | | | |
|---|---|---|---|
| JP | 2002-104288 | A | 4/2002 |
| JP | 2006-199189 | A | 8/2006 |
| JP | 2007-083795 | A | 4/2007 |
| JP | 2010-195388 | A | 9/2010 |
| JP | 2011-016502 | A | 1/2011 |

OTHER PUBLICATIONS

Official Communication issued in International Patent Application No. PCT/JP2012/061867, mailed on Aug. 14, 2012.

* cited by examiner

*Primary Examiner* — Stephen Avila
(74) *Attorney, Agent, or Firm* — Keating & Bennett, LLP

(57) ABSTRACT

An outboard motor control system includes a plurality of outboard motors, a vibration detecting section, and a control section. The outboard motors are mounted on a stern of a watercraft. Each of the outboard motors includes a propeller. The outboard motors are configured to be steered independently of one another. The vibration detecting section is configured to detect a vibration of the outboard motors. The control section is configured and programmed to execute a vibration suppression control when the vibration detecting section detects a vibration of the outboard motors. With the vibration suppression control, the control section is configured and programmed to change a propeller rotational axis direction and/or a propeller position of at least one of the outboard motors.

19 Claims, 9 Drawing Sheets

OUTBOARD MOTOR CONTROL SYSTEM

BACKGROUND OF THE INVENTION

1. Field of the Invention

The present invention relates to a control system for an outboard motor.

2. Description of the Related Art

There are conventional watercrafts in which a plurality of outboard motors are installed on a stern of the watercraft and the outboard motors are coupled together with a rod-shaped device called a tie bar. In such a watercraft, steering angles of the outboard motors are changed in a coordinated manner. Conversely, Laid-open Japanese Patent Application Publication No. 2007-083795 and Laid-open Japanese Patent Application Publication No. 2006-199189 disclose watercrafts in which a plurality of outboard motors are not coupled with a tie bar and, instead, steering angles of the outboard motors are controlled individually. More specifically, in the watercraft disclosed in Laid-open Japanese Patent Application Publication No. 2007-083795, the steering angles of the outboard motors are set according to a traveling performance mode selected by a helmsperson. In the watercraft disclosed in Laid-open Japanese Patent Application Publication No. 2006-199189, target steering angles for a port side outboard motor and a starboard side outboard motor are set individually based on a rotation angle of a steering wheel and an engine rotational speed.

SUMMARY OF THE INVENTION

The inventors of preferred embodiments of the present invention have observed that when the outboard motors are not coupled with a tie bar, the outboard motors exhibit a phenomenon of vibration. This vibration is somewhat different from what would be expected as a result of operating the outboard motor, i.e., the movement of the mechanical parts internal to the engine. What is believed to be the cause of this phenomenon will now be explained. When the outboard motors are not coupled with a tie bar, the steering angles of the outboard motors can be controlled freely but the outboard motors also bear loads individually. When a watercraft travels under such conditions, the outboard motors receive loads from multiple directions, for instance, as a result of the turbulence in the water flow. Such loads, which have partially unpredictable and varying characteristics, are believed to induce resonance in the outboard motor. It is thus believed that the aforementioned phenomenon of vibration of the outboard motors is exhibited. One concern addressed by preferred embodiments of the present invention is that the above-mentioned vibrations may have adverse effects on the steering stability and the service lives of a transom bolt and other portions of the watercraft or of the outboard motor. Another concern is that the above-mentioned vibrations may affect the travelling performance of the watercraft, for instance, causing slightly higher fuel consumption. Another concern is the comfort of the occupants of the watercraft, which may be affected by the noise generated by such vibrations.

Accordingly, preferred embodiments of the present invention provide an outboard motor control system for a watercraft including a plurality of outboard motors installed such that their steering angles are configured to be set individually, wherein the control system suppresses or prevents the vibrations described above.

Laid-open Japanese Patent Application Publication No. 2002-104288 discloses a technology that stabilizes a watercraft by controlling the steering angles of a plurality of propulsion devices when vibration of the watercraft is detected. However, while Laid-open Japanese Patent Application Publication No. 2002-104288 addresses the problem of an entire watercraft vibrating, it does not address the phenomenon of an outboard motor mounted externally to a watercraft itself undergoing vibration, and thus addresses a problem that is different from that addressed by the preferred embodiments of the present invention.

An outboard motor control system according to a preferred embodiment of the present invention includes a plurality of outboard motors, a vibration detecting section, and a control section. The outboard motors are mounted on the stern of the watercraft. Each of the outboard motors includes a propeller. The outboard motors are configured to be steered independently of one another. The vibration detecting section detects a vibration of the outboard motors. The control section is programmed and configured to execute a vibration suppression control when the vibration detecting section detects a vibration of the outboard motors. With the vibration suppression control, the control section is programmed and configured to change a direction of a rotational axis of the propeller and/or a position of the propeller with respect to at least one of the outboard motors.

An outboard motor control method according to another preferred embodiment of the present invention is a control method for a plurality of outboard motors that are mounted on a stern of a watercraft, each including a propeller and configured to be steered individually of one another. The method includes detecting a vibration of an outboard motor and executing a vibration suppression control when the vibration detecting section detects a vibration of the outboard motor. The vibration suppression control is performed so as to change a direction of a rotational axis of the propeller and/or a position of the propeller with respect to at least one of the outboard motors.

With the outboard motor control system according to the first preferred embodiment of the present invention, when a vibration of an outboard motor is detected, the control section changes a direction of a rotational axis of the propeller or a position of the propeller with respect to at least one of the outboard motors. As a result, the outboard motor escapes or exits from the resonance state. Thus, with an outboard motor control system according to this preferred embodiment, the phenomenon of an outboard motor exhibiting a vibration is suppressed or prevented.

With the outboard motor control method according to another preferred embodiment of the present invention, when a vibration of an outboard motor is detected, a direction of a rotational axis of the propeller or a position of the propeller is changed with respect to at least one of the outboard motors. As a result, the outboard motor escapes or exits from the resonance state. Thus, with an outboard motor control method according to this preferred embodiment, the phenomenon of an outboard motor exhibiting a vibration is suppressed or prevented.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
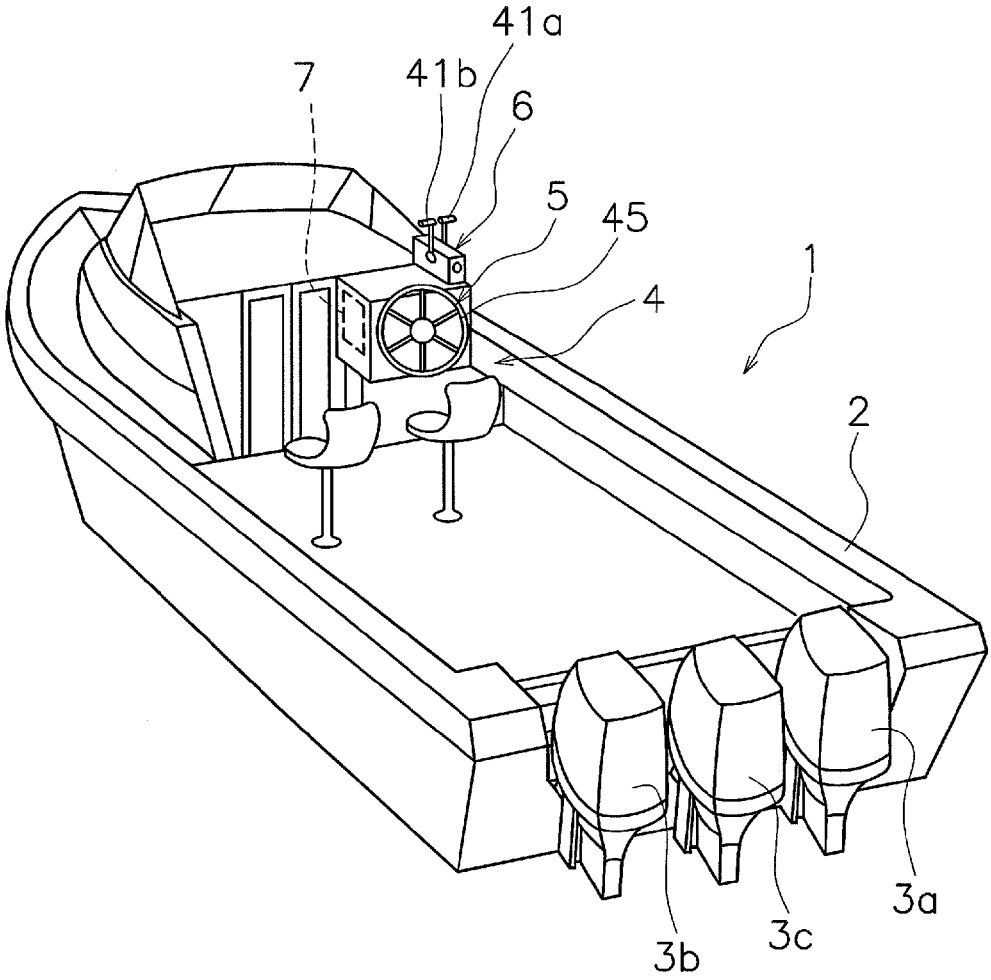
FIG. 1 is perspective view of a watercraft equipped with an outboard motor control system according to a preferred embodiment of the present invention.

Preferred embodiments of the present invention will now be explained with reference to the drawings. FIG. 1 is a perspective view of a watercraft 1. The watercraft 1 is equipped with an outboard motor control system according to a preferred embodiment of the present invention. As shown in FIG. 1, the watercraft 1 includes a hull 2 and a plurality of outboard motors 3*a* to 3*c*. In this preferred embodiment, the watercraft 1 includes three outboard motors (hereinafter called "first outboard motor 3*a*," "second outboard motor 3*b*," and "third outboard motor 3*c*"). The first outboard motor 3*a*, the second outboard motor 3*b*, and the third outboard motor 3*c* are mounted on a stern of the hull 2. The first outboard motor 3*a*, the second outboard motor 3*b*, and the third outboard motor 3*c* are arranged side-by-side along a widthwise direction on a stern of the hull 2. More specifically, the first outboard motor 3*a* is arranged on a starboard side of the stern. The second outboard motor 3*b* is arranged on a port side of the stern. The third outboard motor 3*c* is arranged in a middle of the stern between the first outboard motor 3*a* and the second outboard motor 3*b*. The first outboard motor 3*a*, the second outboard motor 3*b*, and the third outboard motor 3*c* each generate a propulsion force that propels the watercraft 1.

The hull 2 includes a helm seat 4. A steering device 5, a remote control device 6, and a controller 7 are arranged at the helm seat 4. The steering device 5 is a device with which an operator manipulates a turning direction of the watercraft 1. The remote control device 6 is a device with which an operator adjusts a vessel speed. The remote control device 6 is also a device with which an operator switches between forward and reverse driving of the watercraft 1. The controller 7 controls the outboard motors 3*a* to 3*c* in accordance with operating signals from the steering device 5 and the remote control device 6.

Figure 2:
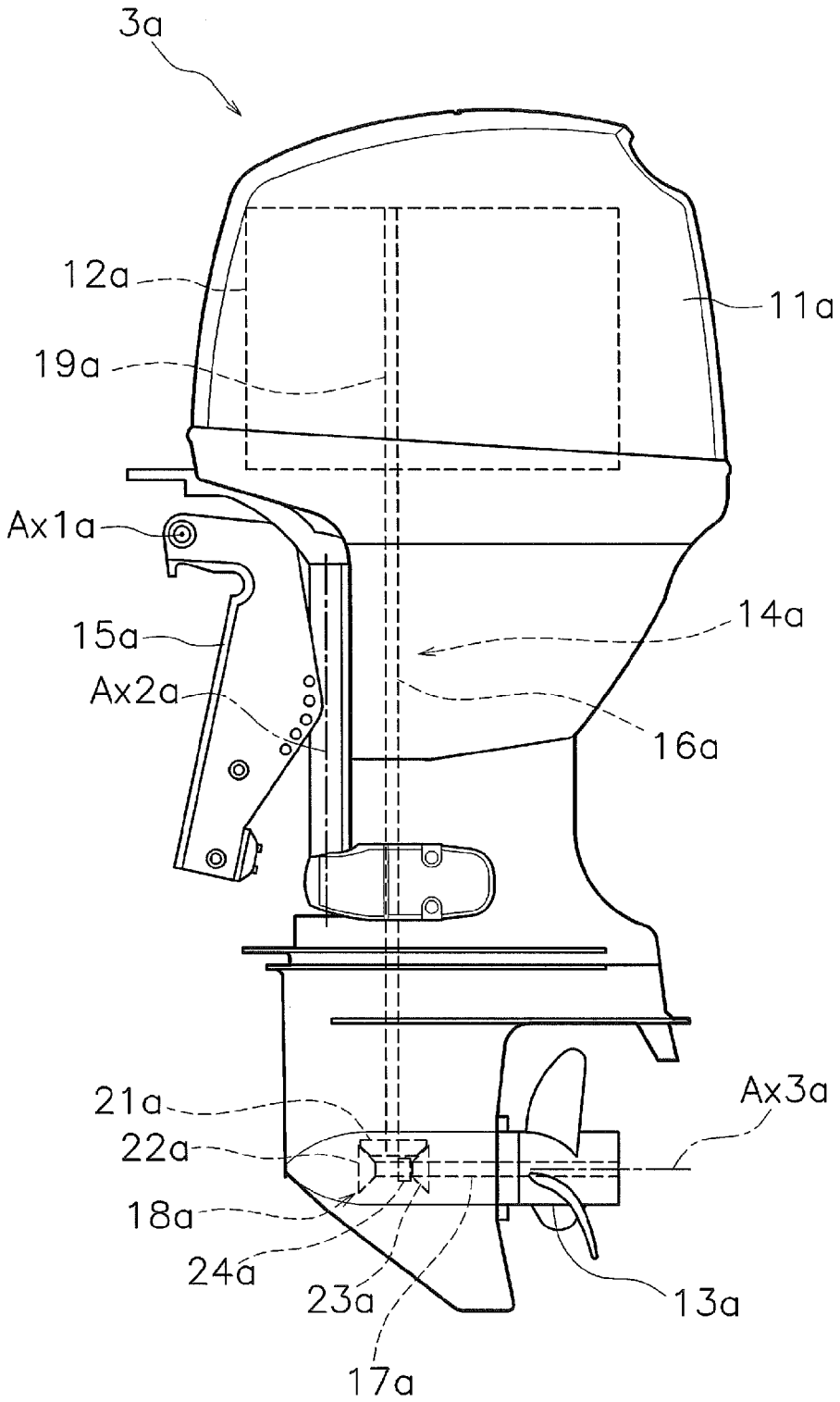
FIG. 2 is a side view of an outboard motor.

FIG. 2 is a side view of the first outboard motor 3*a*. The structure of the first outboard motor 3*a* will now be explained; the structure of the second outboard motor 3*b* and the third outboard motor 3*c* is the same as the structure of the first outboard motor 3*a*. The first outboard motor 3*a* includes a cover member 11*a*, a first engine 12*a*, a propeller 13*a*, a power transmitting mechanism 14*a*, and a bracket 15*a*. The cover member 11*a* houses the first engine 12*a* and the power transmitting mechanism 14*a*. The first engine 12*a* is arranged in an upper portion of the first outboard motor 3*a*. The first engine 12*a* is an example of a power source that generates power to propel the watercraft 1. The propeller 13*a* is arranged in a lower portion of the first outboard motor 3*a*. The propeller 13*a* is rotationally driven by a drive force from the first engine 12*a*. The power transmitting mechanism 14*a* transmits a drive force from the first engine 12*a* to the propeller 13*a*. The power transmitting mechanism 14*a* includes a drive shaft 16*a*, a propeller shaft 17*a*, and a shift mechanism 18*a*. The drive shaft 16*a* is arranged along a vertical direction.

The drive shaft 16*a* is coupled to a crankshaft 19*a* of the first engine 12*a* and transmits power from the first engine 12*a*. The propeller shaft 17*a* is arranged along a longitudinal direction (front-back direction) of the hull 2. The propeller shaft 17*a* connects to a lower portion of the drive shaft 16*a* through the shift mechanism 18*a*. The propeller shaft 17*a* transmits a drive force from the drive shaft 16*a* to the propeller 13*a*.

The shift mechanism 18*a* is configured to change a rotation direction of power transmitted from the drive shaft 16*a* to the propeller shaft 17*a*. The shift mechanism 18*a* preferably includes a pinion gear 21*a*, a forward propulsion gear 22*a*, a reverse propulsion gear 23*a*, and a dog clutch 24*a*. The pinion gear 21*a* is connected to the drive shaft 16*a*. The pinion gear 21*a* meshes with the forward propulsion gear 22*a* and the reverse propulsion gear 23*a*. The forward propulsion gear 22*a* and the reverse propulsion gear 23*a* are arranged such that they undergo relative rotation with respect to the propeller shaft 17*a*. The dog clutch 24s is configured and arranged to move along an axial direction (indicated as Ax3*a*) of the propeller shaft 17*a* to a forward propulsion position, a reverse propulsion position, and a neutral position. The neutral position is a position between the forward propulsion position and the reverse propulsion position. When the dog clutch 24*a* is positioned in the forward propulsion position, rotation of the drive shaft 16*a* is transmitted to the propeller shaft 17*a* through the forward propulsion gear 22*a*. As a result, the propeller 13*a* rotates in a direction of propelling the hull 2 forward. When the dog clutch 24*a* is positioned in the reverse propulsion position, rotation of the drive shaft 16*a* is transmitted to the propeller shaft 17*a* through the reverse propulsion gear 23*a*. As a result, the propeller 13*a* rotates in a direction of propelling the hull 2 in reverse. When the dog switch 24*a* is positioned in the neutral position, the forward propulsion gear 22*a* and the reverse propulsion gear 23*a* rotate relative to the propeller shaft 17*a*. Thus, rotation from the drive shaft 16 is not transmitted to the propeller shaft 17*a* and the propeller shaft 17*a* rotates idly.

The bracket 15*a* is a mechanism configured to mount the first outboard motor 3*a* to the hull 2. The first outboard motor 3*a* is fixed detachably to the stern of the hull 2 through the bracket 15*a*. The first outboard motor 3*a* is mounted such that it can turn about a tilt axis Ax1*a* of the bracket 15*a*. The tilt axis Ax1*a* extends in a widthwise direction of the hull 2. The first outboard motor 3*a* is mounted such that it can turn about a steering axis Ax2*a* of the bracket 15*a*. A steering angle is changed by turning the first outboard motor 3*a* about the steering axis Ax2*a*. The steering angle is an angle that the direction of a propulsion force makes with a centerline extending along a longitudinal direction of the hull 2. Thus, the steering angle is an angle that a rotational axis Ax3*a* of the propeller 13*a* makes with the centerline extending along a longitudinal direction of the hull 2. Also, by turning the first outboard motor 3*a* about the tilt axis Ax1*a*, a trim angle of the first outboard motor 3*a* is changed. The trim angle is equivalent to a mounting angle of the outboard motor with respect to the hull 2.

Figure 3:
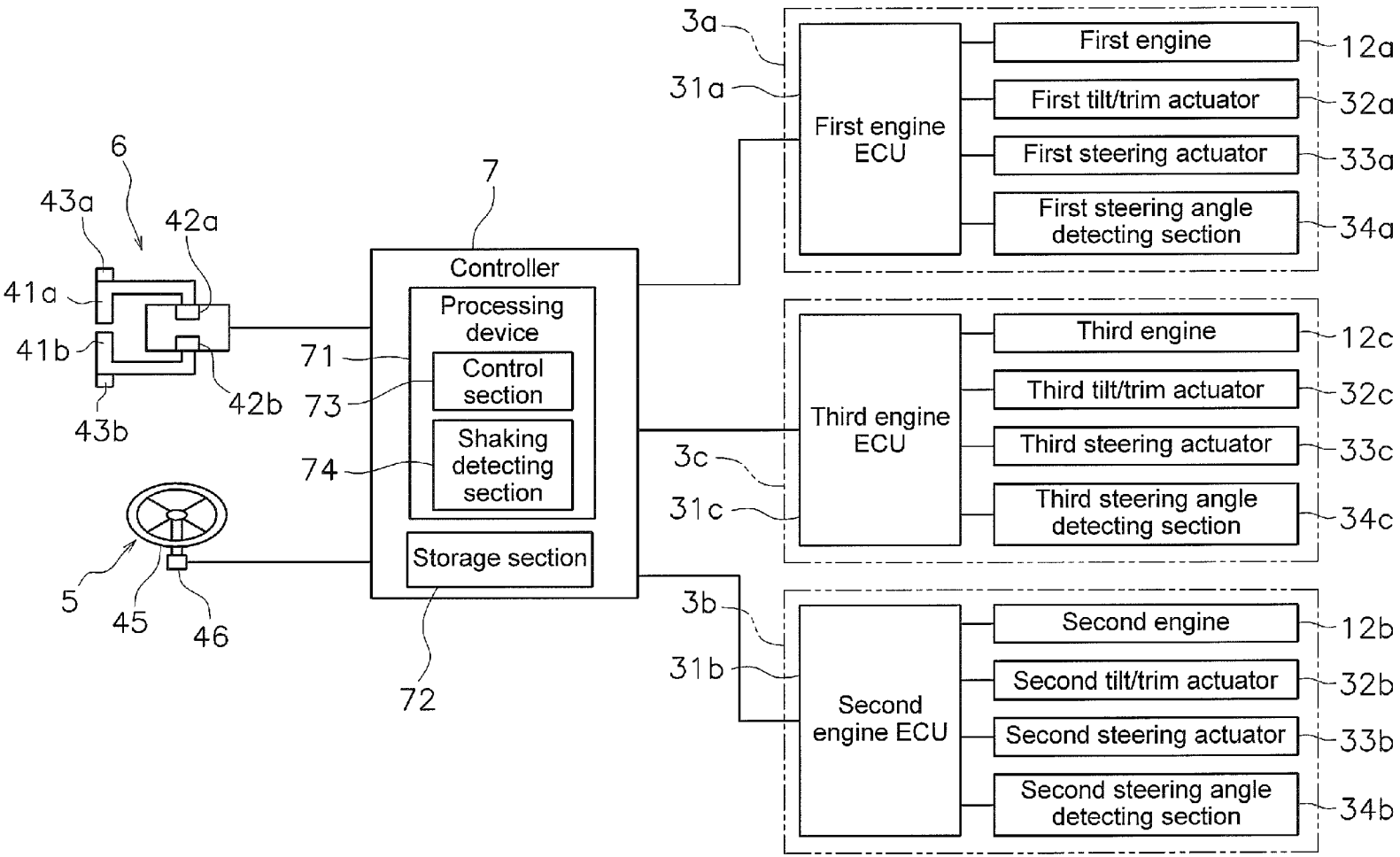
FIG. 3 is a block diagram showing constituent features of an outboard motor control system.

FIG. 3 is a block diagram showing constituent features of an outboard motor control system according to a preferred embodiment of the present invention. The outboard motor control system includes the first outboard motor 3*a*, the second outboard motor 3*b*, the third outboard motor 3*c*, the steering device 5, the remote control device 6, and the controller 7.

The first outboard motor 3*a* includes the first engine 12*a*, a first engine ECU 31*a* (electronic control unit), a first tilt/trim actuator 32*a*, a first steering actuator 33*a*, and a first steering angle detecting section 34*a*.

The first tilt/trim actuator 32*a* turns the first outboard motor 3*a* about the tilt axis Ax1*a* of the bracket 15*a*. In this manner, a tilt angle of the first outboard motor 3*a* is changed. The first tilt/trim actuator 32*a* includes, for example, a hydraulic cylinder. The first steering actuator 33*a* turns the first outboard motor 3*a* about the steering axis Ax2*a* of the bracket 15*a*. In this manner, the steering angle of the first outboard motor 3*a* is changed. The first steering actuator 33*a* includes, for example, a hydraulic cylinder.

The first steering angle detecting section 34*a* detects an actual steering angle of the first outboard motor 3*a*. If the first steering actuator 33*a* is a hydraulic cylinder, then the first steering angle detecting section 34*a* is, for example, a stroke sensor for the hydraulic cylinder. The first steering angle detecting section 34*a* sends a detection signal to the first engine ECU 31*a*.

The first engine ECU 31*a* stores a control program for the first engine 12*a*. The first engine ECU 31*a* controls operations of the first engine 12*a*, the first tilt/trim actuator 32*a*, and the first steering actuator 33*a* based on a signal from the steering device 5, a signal from the remote control device 6, a detection signal from the first steering angle detecting section 34*a*, and detection signals from other sensors (not shown in the drawings) installed in the first outboard motor 3*a*. The first engine ECU 31*a* is connected to the controller 7 through a communication line. It is also acceptable for the first engine ECU 31*a* to be capable of communicating with the controller 7 wirelessly.

The second outboard motor 3*b* includes a second engine 12*b*, a second engine ECU 31*b*, a second tilt/trim actuator 32*b*, a second steering actuator 33*b*, and a second steering angle detecting section 34*b*. The third outboard motor 3*c* includes a third engine 12*c*, a third engine ECU 31*c*, a third tilt/trim actuator 32*c*, a third steering actuator 33*c*, and a third steering angle detecting section 34*c*. Since the component devices of the second outboard motor 3*b* and the third outboard motor 3*c* have the same functions as the component devices of the first outboard motor 3*a*, detailed descriptions of these devices will be omitted. Also, in FIG. 3 component devices of the first outboard motor 3*a* and the second outboard motor 3*b* that correspond to each other are indicated with the same reference numerals. Similarly, component devices of the first outboard motor 3*a* and the third outboard motor 3*c* that correspond to each other are indicated with the same reference numerals.

The remote control device 6 includes a first operating member 41*a*, a first operating position sensor 42*a*, a first PTT operating member 43*a*, a second operating member 41*b*, a second operating position sensor 42*b*, and a second PTT operating member 43*b*. The first operating member 41*a* is, for example, a lever. The first operating member 41*a* can be tilted forward and rearward. The first operating position sensor 42*a* detects an operating position of the first operating member 41*a*. When an operator operates the first operating member 41*a*, the dog clutch 24*a* of the first outboard motor 3*a* is set to a shift position corresponding to the operating position of the first operating member 41*a*. In this manner, an operator changes the rotation direction of the propeller 13*a* of the first outboard motor 3*a* between a forward direction and a reverse direction. Also, a target engine rotational speed of the first outboard motor 3*a* is set to a value corresponding to the operating position of the first operating member 41*a*. Thus, the operator is capable of adjusting a rotational speed of the propeller 13*a* of the first outboard motor 3*a*. The first PTT operating member 43*a* is, for example, a switch. When an operator operates the first PTT operating member 43*a*, the first tilt/trim actuator 32*a* is driven. In this manner, the operator is capable of changing a trim angle of the first outboard motor 3*a*.

The second operating member 41*b* preferably is, for example, a lever. The second operating member 41*b* is arranged side-by-side (left and right) with the first operating member 41*a*. The second operating member 41*b* is configured to be tilted forward and rearward. The second operating position sensor 42*b* detects an operating position of the second operating member 41*b*. When an operator operates the second operating member 41*b*, the dog clutch of the second outboard motor 3*b* is set to a shift position corresponding to the operating position of the second operating member 41*b*. In this manner, an operator is capable of changing the rotation direction of a propeller of the second outboard motor 3*b* between a forward direction and a reverse direction. A target engine rotational speed of the second outboard motor 3*b* is set to a value corresponding to the operating position of the second operating member 41*b*. Thus, the operator is capable of adjusting a rotational speed of the propeller of the second outboard motor 3*b*. The second PTT operating member 43*b* preferably is, for example, a switch. When an operator operates the second PTT operating member 43*b*, the second tilt/trim actuator 32*b* is driven. In this manner, the operator is capable of changing a trim angle of the second outboard motor 3*b*.

Switching the propulsion direction of the third outboard motor 3*c* between forward and reverse and setting a target engine rotational speed of the third outboard motor 3*c* are accomplished according to operations of the first operating member 41*a* and the second operating member 41*b*. More specifically, if the shift positions corresponding to the operating positions of both the first operating member 41*a* and the second operating member 41*b* are the same, then the dog clutch of the third outboard motor 3*c* preferably is set to that same shift position. The target engine rotational speed of the third outboard motor 3*c* is preferably set to an average value of the target engine rotational speed of the first outboard motor 3*a* and the target engine rotational speed of the second outboard motor 3*b*. It is also acceptable for the target engine rotational speed of the third outboard motor 3*c* to be set to a value different from the average value described above. If the shift positions corresponding to the operating positions of both the first operating member 41*a* and the second operating member 41*b* are not the same, then the dog clutch of the third outboard motor 3*c* is preferably set to a neutral position. In such a case, the target engine rotational speed of the third outboard motor 3*c* is preferably set to a prescribed idle rotational speed.

A detection signal from the first operating position sensor 42*a* and a detection signal from the second operating position sensor 42*b* are transmitted to the controller 7. Operation signals from the first PTT operating member 43*a* and the second PTT operating member 43*b* are also transmitted to the controller 7.

The steering device 5 includes a steering member 45 and a steering position sensor 46. The steering member 45 is, for example, a steering wheel. The steering member 45 is a member configured to set a target steering angle of the first to third outboard motors 3*a* to 3*c*. The steering position sensor 46 detects an operating amount, i.e., an operating angle, of the steering member 45. A detection signal from the steering position sensor 46 is transmitted to the controller 7. When an operator operates the operating member 45, the first steering actuator 33*a*, the second steering actuator 33*b*, and the third steering actuator 33*c* are driven. As a result, the operator is able to adjust an advancing direction of the watercraft 1. The controller 7 controls the first steering actuator 33*a*, the second steering actuator 33*b*, and the third steering actuator 33*c* independently. Thus, the first to third outboard motors 3*a* to 3*c* are steered independently of each other.

Figure 4:
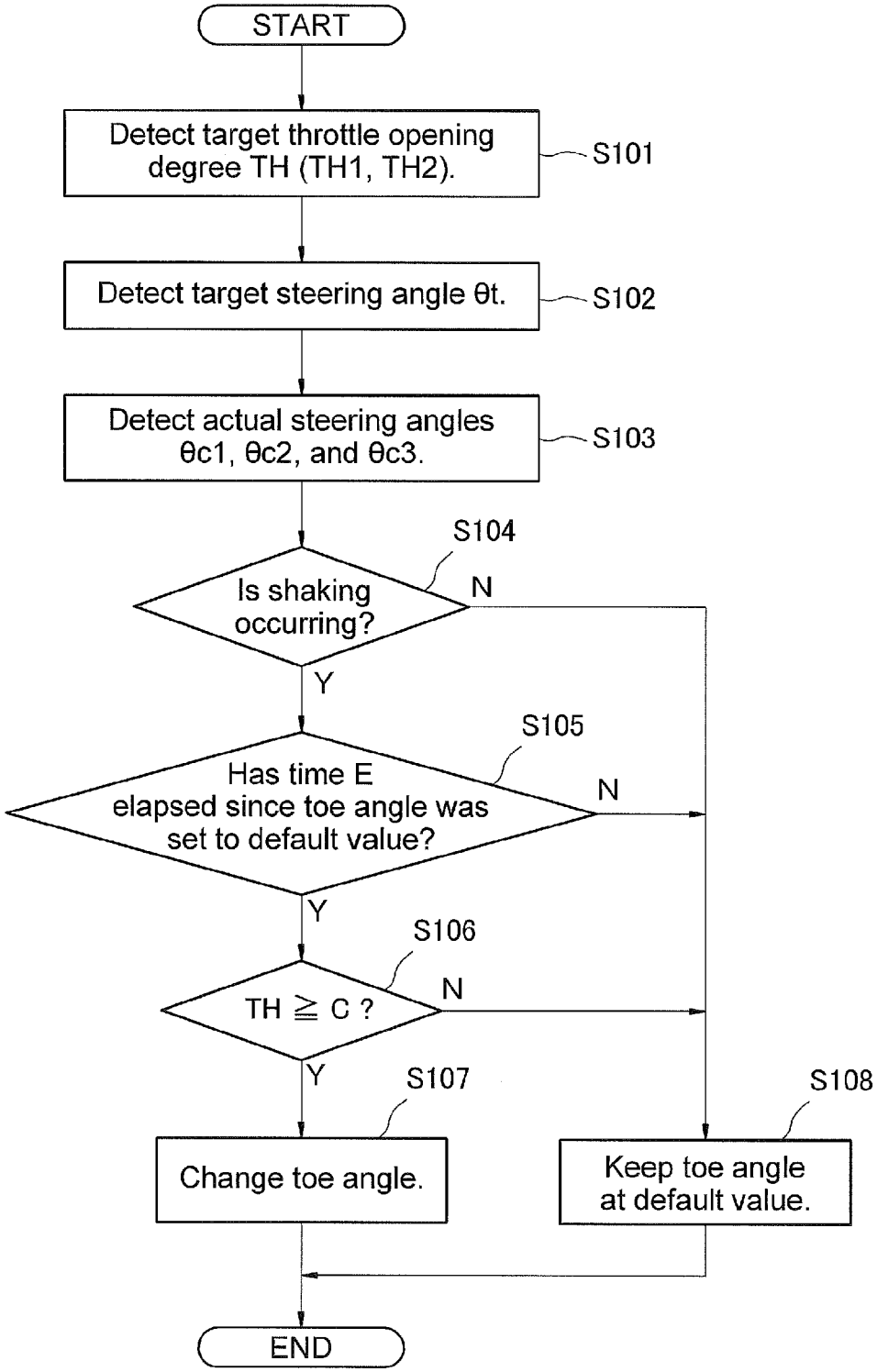
FIG. 4 is a flowchart showing processing steps of a vibration suppression control.

The controller 7 includes a processing device 71 such as a CPU and a storage device 72. The storage device 72 includes a semiconductor storage device, e.g., a RAM or a ROM, or such a device as a hard disk or a flash memory. The storage device 72 stores programs and data to control the first to third outboard motors 3*a* to 3*c*. The controller 7 sends command signals to the first to third engine ECUs 31*a* to 31*c* based on signals from the steering device 5 and the remote control device 6. In this manner, the first to third outboard motors 3*a* and 3*c* are controlled. The processing device 71 of the controller 7 includes a control section 73 and a vibration detecting section 74. The vibration detecting section 74 detects vibrations of the first to third outboard motors 3*a* to 3*c*. The control section 73 executes a control (hereinafter called "vibration suppression control") to suppress or prevent the occurrence of vibration of the first to third outboard motors 3*a* to 3*c* when the vibration detecting section detects a vibration of the first to third outboard motors 3*a* to 3*c*. FIG. 4 is a flowchart showing processing steps related to a vibration suppression control.

In step S101, the first operating position sensor 42*a* and the second operating position sensor 42*b* detect target throttle opening degrees TH1 and TH2. The target throttle opening degree TH1 detected by the first operating position sensor 42*a* is set according to an operating amount of the first operating member 41*a* such that a fully open state is expressed as an opening degree of 100%. The target throttle opening degree TH2 detected by the second operating position sensor 42*b* is set according to an operating amount of the second operating member 41*b* such that a fully open state is expressed as an opening degree of 100%. Thus, the first operating member 41*a* and the second operating member 41*b* are examples of the throttle operating member mentioned in the claims. The vibration detecting section 74 uses an average value of a target throttle opening degree TH1 detected by the first operating position sensor 42*a* and a target throttle opening degree TH2 detected by the second operating position sensor 42*b* as a target throttle opening degree TH to determine if a vibration is occurring.

In step S102, the steering position sensor 46 detects a target steering angle θt. The target steering angle θt is set according to an operating amount of the steering member 45.

In step S103, the first to third steering angle detecting sections 34*a* to 34*c* detect actual steering angles θc1 to θc3. More specifically, the first steering angle detecting section 34*a* detects an actual steering angle θc1 of the first outboard motor 3*a*. The second steering angle detecting section 34*b* detects an actual steering angle θc2 of the second outboard motor 3*b*. The third steering angle detecting section 34*c* detects an actual steering angle θc3 of the third outboard motor 3*c*.

Figure 5:
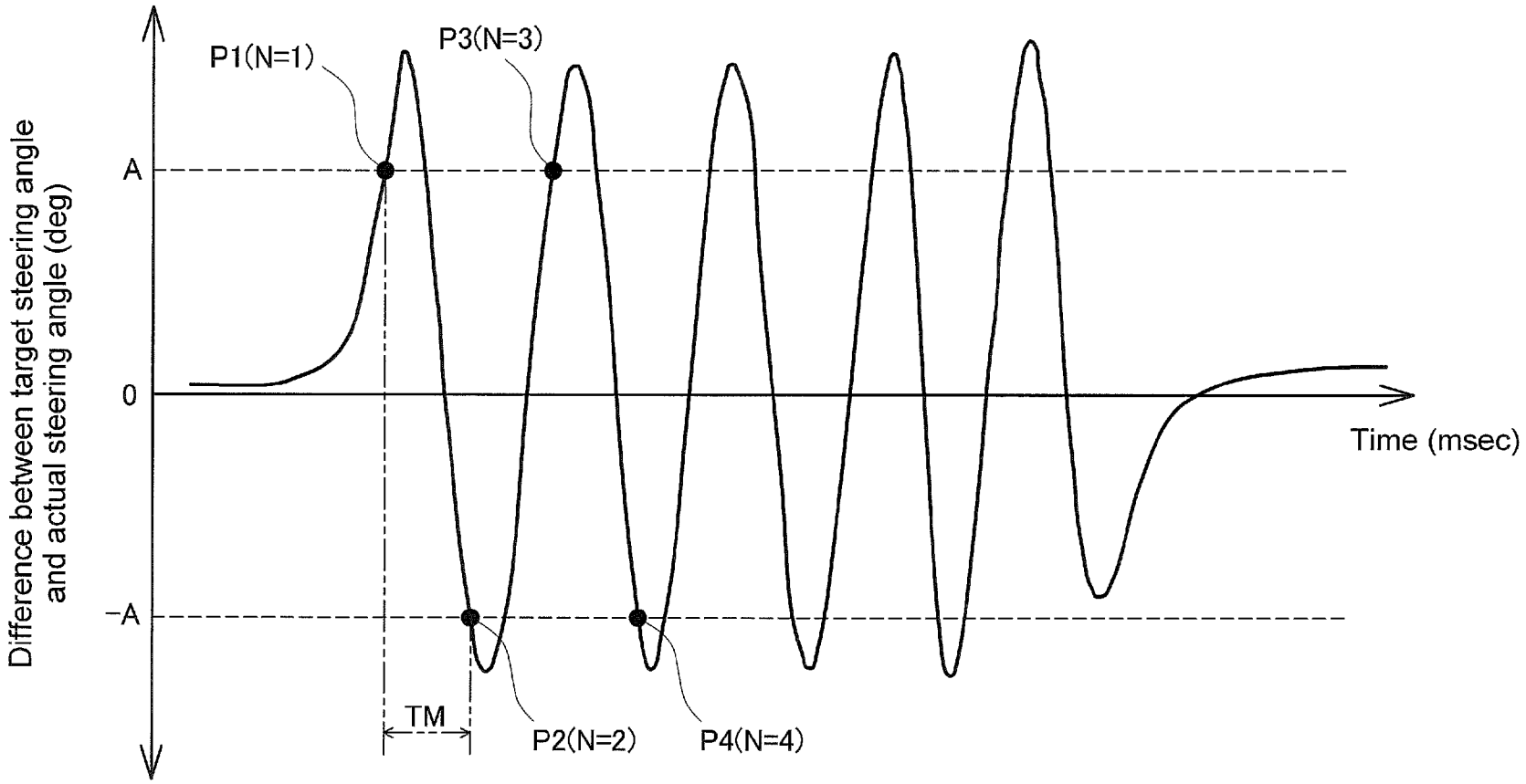
FIG. 5 illustrates a method of detecting a vibration.

In step S104, the vibration detecting section 74 determines if a vibration is occurring. A process executed to determine if a vibration is occurring will now be explained with reference to FIG. 5. FIG. 5 indicates how a difference between a target steering angle θt and an actual steering angle θc (hereinafter called "steering angle difference") varies with time when a vibration is occurring in one of the outboard motors. The vibration detecting section 74 determines if the steering angle difference exceeds a prescribed positive threshold value A. If the steering angle difference exceeds the prescribed positive threshold value A (see P1 in FIG. 5), then the vibration detecting section 74 increments a vibration repetition count N to 1. Next, the vibration detecting section 74 determines if the steering angle difference exceeds a prescribed negative threshold value −A. If the steering angle difference exceeds the prescribed negative threshold value −A (see P2 in FIG. 5), then the vibration detecting section 74 determines if the change between the state in which the steering angle difference exceeded the prescribed positive threshold value A and the state in which the steering angle difference exceeds the prescribed negative threshold value −A occurred within a prescribed amount of time. In other words, the vibration detecting section 74 determines if an elapsed time TM from a point in time in a previous cycle when the steering angle difference exceeded the prescribed positive threshold value A to a point in time when the steering angle difference exceeded the prescribed negative threshold value −A is smaller than a prescribed amount of time B. If the elapsed time TM is smaller than the prescribed time B, then the repetition count N is incremented to 2. Next, the vibration detecting section 74 determines if the steering angle difference exceeds the prescribed positive threshold value A. If the steering angle difference exceeds the prescribed positive threshold value A (see P3 in FIG. 5), then the vibration detecting section 74 determines if an elapsed time TM from a point in time in a previous cycle when the steering angle difference exceeded the prescribed negative threshold value −A to a point in time when the steering angle difference exceeded the prescribed positive threshold value A is smaller than the prescribed amount of time B. If the elapsed time TM is smaller than the prescribed time B, then the vibration detecting section 74 increments the vibration repetition count N to 3. In this manner, the vibration detecting section 74 detects a vibration when a change between a state in which a difference between a target steering angle θt and an actual steering angle θc exceeds a prescribed positive threshold value A and a state in which a difference between a target steering angle θt and an actual steering angle θc exceeds a prescribed negative threshold value −A occurs within a prescribed amount of time B and the change is repeated continuously for at least a prescribed number of times N. In FIG. 5, the prescribed number of times N is preferably 4, for example, and the vibration detecting section 74 detects that a vibration is occurring when the repetition count N has reached 4 (see P4 of FIG. 5). The prescribed number of times N is not limited to 4 and can be another number. The threshold value A corresponds to an amplitude of the change of the steering angle difference and preferably is, for example, a value equal to or smaller than about 1 degree. The prescribed amount of time B is, for example, equal to or smaller than about 1 second. The vibration detection section 74 executes the vibration occurrence determination explained above with respect to each of the first to third outboard motors 3*a* to 3*c* and detects that a vibration is occurring when the vibration detection section 74 determines that a vibration is occurring in at least one of the outboard motors.

If the vibration detecting section 74 detects that a vibration is occurring in step S104, then in step S105 the control section 73 determines if an amount of time E has elapsed since a toe angle θ explained below (see FIG. 6) was set to a default value. In the process shown in FIG. 8 explained below, a control to suppress or prevent the vibration is executed by returning the toe angle θ to the default value. The processing of steps S104 and S105 serves to detect a reoccurrence of vibration after the toe angle θ was changed in a previous control cycle. If the control section 73 determines in step S105 that the amount of time E has elapsed since the toe angle θ was set to the default value, then the control section 73 executes step S106.

In step S106, the control section 73 determines if the target throttle opening degree TH is equal to or larger than a prescribed value C. The prescribed value C is, for example, a fixed value indicating a throttle opening degree corresponding to a vessel speed at which vibration can occur. If the target throttle opening degree TH is equal to or larger than prescribed value C, then the control section 73 executes step S107.

Figure 6A:
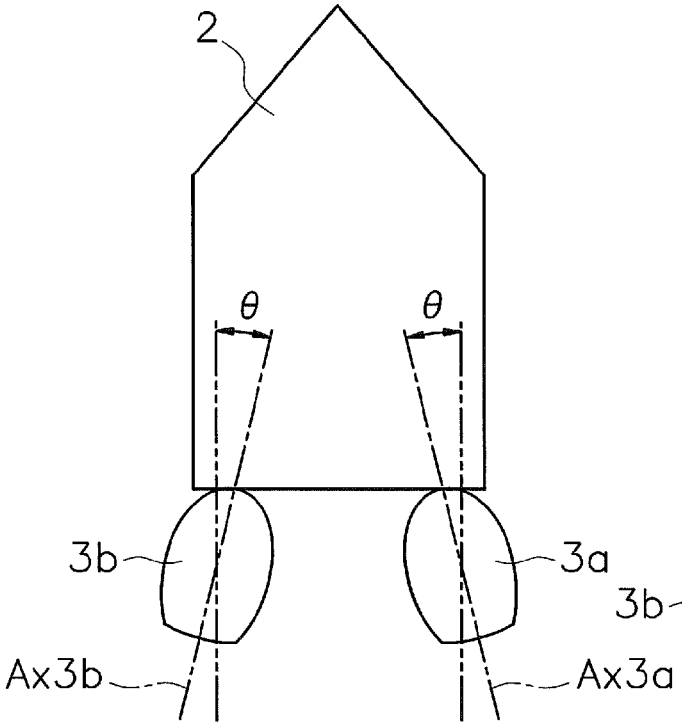
FIGS. 6A and 6B are simple diagrams illustrating toe angles of a toe-in state and a toe-out state.
Figure 6B:
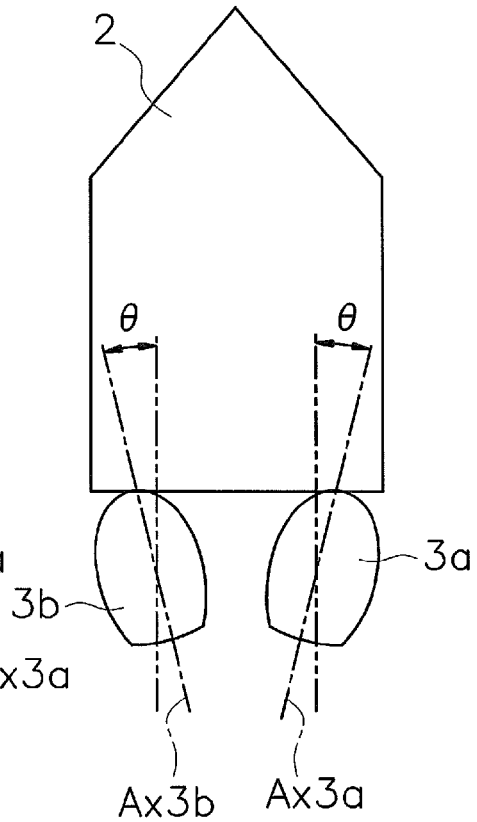
Figures 7A, 7B, 7C, 7D:
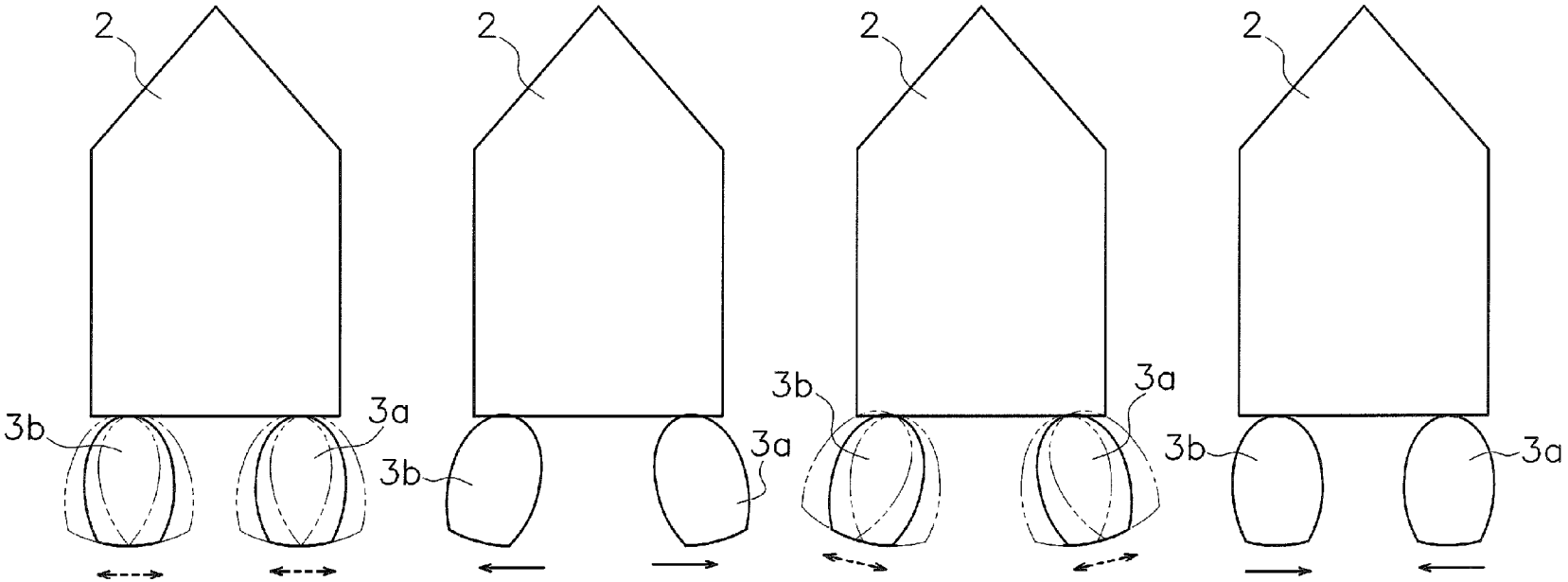
FIGS. 7A to 7D are simple diagrams illustrating toe angle changes executed when a vibration is detected.

In step S107, the control section 73 changes the toe angle of the first outboard motor 3*a* and the second outboard motor 3*b*. As shown in FIG. 6, the toe angle θ is an angle that the rotational axes Ax3*a* and Ax3*b* of the propellers of the outboard motors 3*a* and 3*b* make with respect to an advancement direction of the hull 2. Thus, by changing the toe angle θ of the outboard motors 3*a* and 3*b*, the control section 73 changes a direction of the rotational axes Ax3*a* and Ax3*b* of the propellers of the outboard motors 3*a* to 3*c*. In FIGS. 6 and 7, the third outboard motor 3*c* is omitted. A change of the toe angle θ is called "toe in" when it results in a state in which the propeller of the first outboard motor 3*a* and the propeller of the second outboard motor 3*b* are farther away from each other as shown in FIG. 6A. A change of the toe angle θ is called "toe out" when it results in a state in which the propeller of the first outboard motor 3*a* and the propeller of the second outboard motor 3*b* are closer together as shown in FIG. 6B. In step S107, the control section 73 changes the toe angle of the first outboard motor 3*a* and the second outboard motor 3*b* in the toe-in direction. The control section 73 changes the toe angle θ of the first outboard motor 3*a* and the second outboard motor 3*b* in the toe-in direction by a prescribed angle D. For example, when the first outboard motor 3*a* and the second outboard motor 3*b* are vibrating as shown in FIG. 7A, the controller 73 changes the toe angle θ of the first outboard motor 3*a* and the second outboard motor 3*b* in the toe-in direction as shown in FIG. 7B. FIG. 7A depicts a state in which the outboard motors are in a resonating state; by changing the toe angle θ as shown in FIG. 7B, the outboard motors escape a resonance point of vibration. As a result, the vibration of the outboard motors is suppressed or prevented. The prescribed angle D is, for example, a fixed value. It is also acceptable if the prescribed angle D is changed. The prescribed angle D is set to a value appropriate for the outboard motors to escape from a resonating state. For example, the prescribed value D is larger than a threshold value A corresponding to an amplitude of the previously explained change of the steering angle difference. The prescribed value C of the target throttle opening degree TH and the prescribed angle D are preferably set when initial settings of the first to third outboard motors 3*a* to 3*c* are made.

If the vibration detecting section 74 does not detect an occurrence of vibration in step S104, then the control section 73 executes step S108. If the control section 73 determines in step S105 that the amount of time E has not elapsed since the toe angle θ was set to the default value, then the control section 73 executes step S108. If the control section 73 determines in step S106 that the target throttle opening degree TH is smaller than the prescribed value C, then the control section 73 executes step S108. In step S108, the control section 73 keeps the toe angle θ at the default value. That is, if the target throttle opening degree is smaller than the prescribed value C, then the control section 73 keeps the steering angles of the outboard motors at the default value without executing the vibration suppression control even if the vibration detecting section 74 detects a vibration of the outboard motors. The reason is that when the target throttle opening degree is smaller than the prescribed value C, the watercraft will decelerate and the vibration will be suppressed or eliminated due to the watercraft slowing down even if the toe angle θ is not changed. As explained previously, the target throttle opening degree TH used in this determination is typically an average value of the target throttle opening degrees TH1 and TH2 of the engines 12*a* and 12*b*, but it is acceptable for the control section 73 to use a target throttle opening degree of an engine at which a vibration was detected. The default value is an angle appropriate for a traveling state of the watercraft 1 encountered when the vibration suppression control is not executed. The default value is set in accordance with, for example, a vessel speed (maximum speed) or an acceleration rate (acceleration performance).

Figure 8:
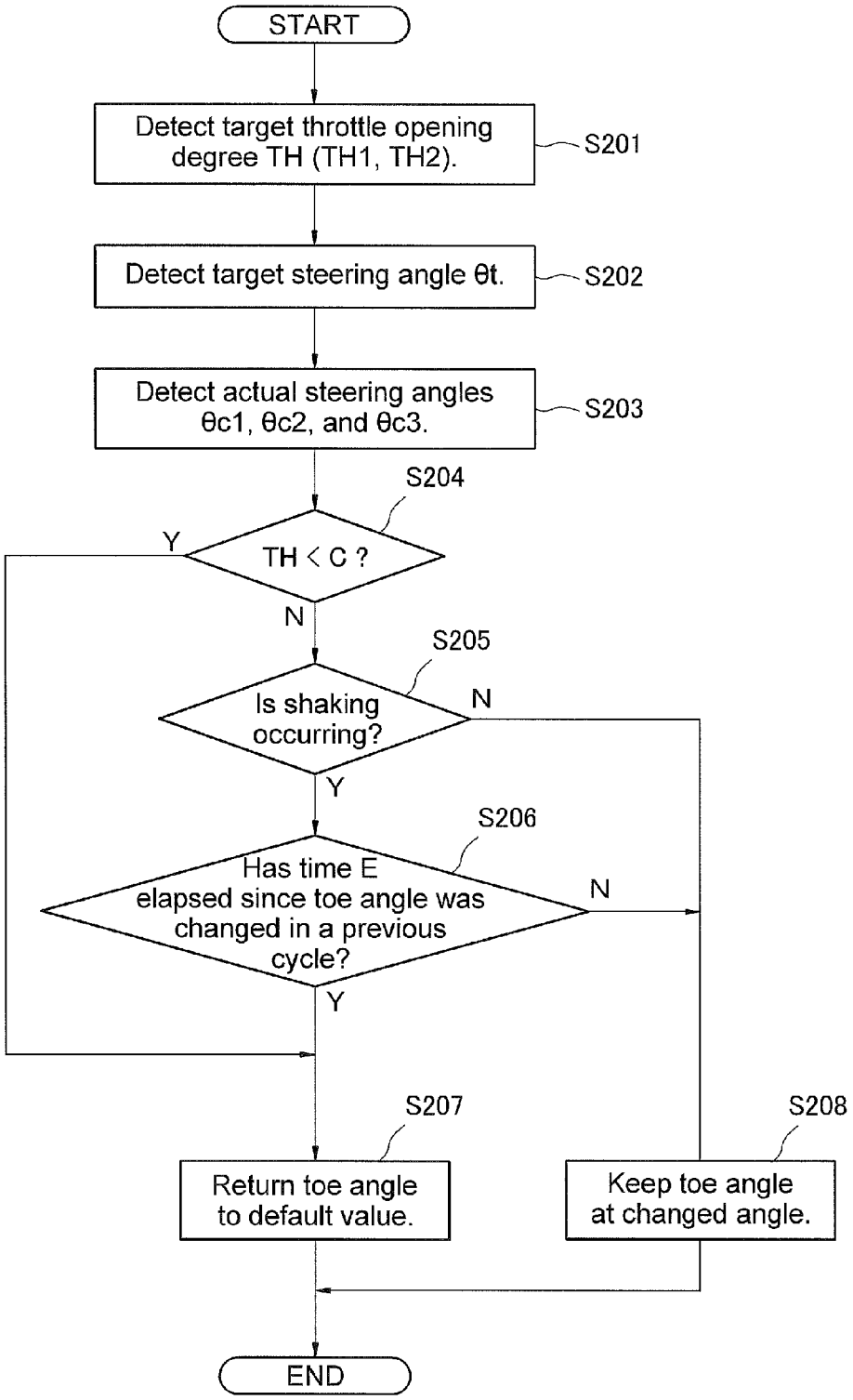
FIG. 8 is a flowchart showing processing steps of a vibration suppression control.

In the process explained above, the control section 73 executes the process shown in FIG. 8 with the toe angle θ in a state of having been changed. Steps S201 to S203 of the process shown in FIG. 8 are preferably the same as the steps S101 to S103 of FIG. 4 and, thus, explanations thereof are omitted here.

In step S204, the control section 73 determines if the target throttle opening degree TH is smaller than the prescribed value C. If the target throttle opening degree TH is smaller than the prescribed value C, then the control section 73 returns the toe angle θ to the default value in step S207. As explained previously, when the target throttle opening degree TH is smaller than the prescribed value C, vibrations are suppressed or eliminated by deceleration of the watercraft.

In step S205, the vibration detecting section 74 determines if a vibration is occurring. The content of step S205 is the same as step S104 and, thus, an explanation thereof is omitted here.

If the vibration detecting section 74 detects an occurrence of vibration in step S205, then the control section 73 executes step S206. In step S206, the control section 73 determines if an amount of time E has elapsed since the toe angle θ was changed in a previous control cycle. Even if a vibration is dissipated or eliminated by changing the toe angle θ according to FIG. 4, there are times when the vibration reoccurs after the toe angle θ has been changed, as shown in FIG. 7C. Therefore, in steps S205 and S206, the control section 73 detects if there has been such a reoccurrence of vibration. If the control section 73 determines in step S206 that the amount of time E has elapsed since the toe angle θ was changed in a previous control cycle, then the control section 73 executes step S207.

In step S207, the control section 73 returns the toe angle θ from the changed angle to the default value. For example, when the first outboard motor 3*a* and the second outboard motor 3*b* are vibrating as shown in FIG. 7C after the toe angle θ has been changed, the control section 73 returns the toe angle θ of the first outboard motor 3*a* and the second outboard motor 3*b* to the default value as shown in FIG. 7D. The return is accomplished by changing the toe angle θ in the toe-out direction. FIG. 7C depicts a state in which the first outboard motor 3*a* and the second outboard motor 3*b* are in a resonating state; by changing the toe angle θ as shown in FIG. 7D, the first outboard motor 3*a* and the second outboard motor 3*b* escape a resonance point of vibration. As a result, the vibrations of the first outboard motor 3*a* and the second outboard motor 3*b* are suppressed or prevented.

If the vibration detecting section 74 does not detect an occurrence of a vibration in step S205, then in step S208 the control section 73 keeps the toe angle θ at the changed angle.

Similarly, if in step S206 the amount of time E has not elapsed since the toe angle θ was changed in a previous control cycle, then in step S208 the control section 73 keeps the toe angle θ at the changed angle.

When the toe angle θ has been returned to the default value in the process shown in FIG. 8, the process shown in FIG. 4 is executed again. Thus, each time the toe angle θ is changed due to the vibration suppression control, the processes shown in FIG. 4 and FIG. 8 are repeated. When the toe angle θ is changed from the default value, the toe angle θ is changed in the toe-in direction as shown in FIG. 7B. When the toe angle θ is returned to the default value, the toe angle θ is changed in the toe-out direction as shown in FIG. 7D. Thus, when the control section 73 changes the toe angle θ of the outboard motors repeatedly as shown in FIG. 7A to 7D, it repeats changes in the toe-in direction and changes in the toe-out direction alternately.

As explained previously, in an outboard motor control system according to the present preferred embodiment, the control section 73 changes the toe angle θ of the first outboard motor 3*a* and the second outboard motor 3*b* when a vibration of an outboard motor is detected. As a result, a phenomenon of an outboard motor exhibiting a vibration is suppressed or prevented without lowering an engine rotational speed.

Although preferred embodiments of the present invention have been explained herein, the present invention is not limited to the preferred embodiments described above. Various changes can be made without departing from the scope of the present invention.

The number of outboard motors is not limited to three. For example, it is acceptable if only the first outboard motor 3*a* and the second outboard motor 3*b* of the previously explained preferred embodiments are mounted on the hull 2. It is also acceptable for four or more outboard motors to be mounted on the hull 2.

Although the first to third steering actuators 33*a* to 33*c* of the previously explained preferred embodiments are hydraulic cylinders, it is also acceptable to use another type of actuator. For example, it is acceptable for the first to third steering actuators 33*a* to 33*c* to be actuators that use an electric motor.

Although in the previously explained preferred embodiments a steering wheel is described as an example of a steering device 5, it is acceptable for a joystick or other steering device to be provided in addition to the steering wheel.

Although in the previously explained preferred embodiments the controller 7 is arranged independently from other devices, it is acceptable to install the controller 7 in another device. For example, it is acceptable to install the controller 7 in the steering device 5.

Figure 9:
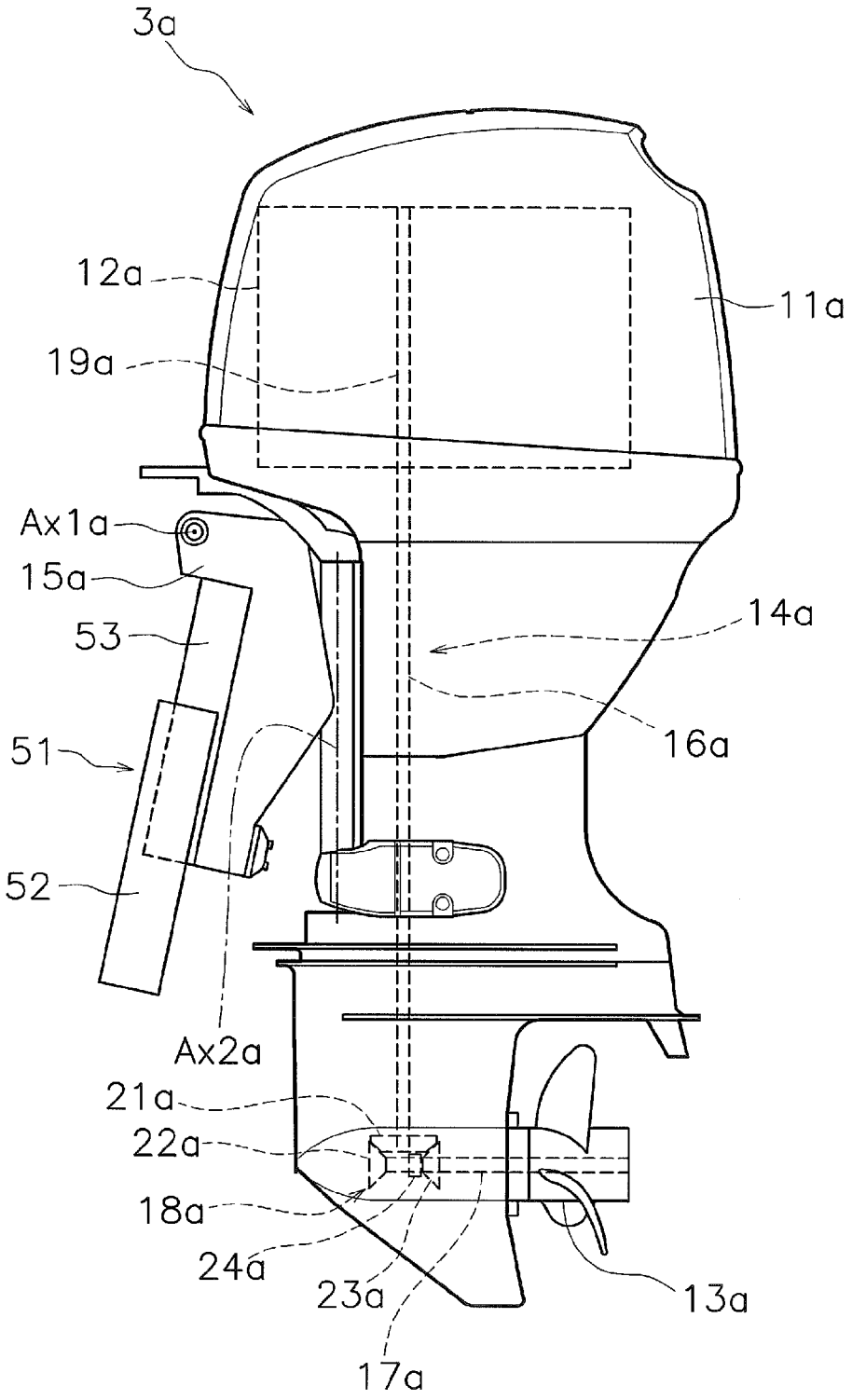
FIG. 9 is a side view of an outboard motor according to another preferred embodiment of the present invention.

Although in the previously explained preferred embodiments the directions of the rotational axes of the propellers are preferably changed by changing the toe angle θ, it is acceptable to use another method to change the directions of the rotational axes of the propellers. For example, it is acceptable to change a target steering angle θt of one of the first to third outboard motors 3*a* to 3*c* or to change the target steering angles θt of all of the first to third outboard motors 3*a* to 3*c*. It is also acceptable to change the direction of a rotational axis of a propeller by changing a trim angle. Furthermore, it is acceptable to accomplish the vibration suppression control by changing a position of a propeller. For example, it is acceptable to provide a slide mechanism 51 on the bracket 15*a* as shown in FIG. 9 and to change the position of the first outboard motor 3*a* using the slide mechanism 51 when a vibration is detected. The slide mechanism 51 includes abase section 52 and a slider section 53. The base section 52 is attached to the hull 2. The slider section 53 is attached to the bracket 15*a*. The slider section 53 is slidably attached to the base section 52. The slider section 53 is moved with respect to the base section 52 by an actuator (not shown in the drawings). When the slider section 53 moves with respect to the base section 52, the first outboard motor 3*a* moves up and down with respect to the hull 2. It is further acceptable for a slide mechanism similar to the slide mechanism 51 to be also provided with respect to the second outboard motor 3*b* and the third outboard motor 3*c*. Thus, when the vibration detecting section 74 detects a vibration, the control section 73 preferably changes the positions of the propellers of the outboard motors 3*a* to 3*c* by raising and lowering the propellers using the slide mechanisms of the outboard motor 3*a* to 3*c*.

The vibration suppression control is executed with respect to at least one of the outboard motors. Thus, it is acceptable to execute the vibration suppression control with respect to one of the first to third outboard motors 3*a* to 3*c* or with respect to all of the first to third outboard motors 3*a* to 3*c*. Moreover, it is acceptable to execute the vibration suppression control with respect to an outboard motor that is not vibrating. A water flow pattern surrounding a vibrating outboard motor preferably is changed and the vibrating outboard motor escapes from a resonating state. As a result, vibration is suppressed or prevented. The third outboard motor 3*c* does not exhibit vibration as readily as the first outboard motor 3*a* and the second outboard motor 3*b*. The reason is that, in general, the propeller of the third outboard motor 3*c* is arranged in a position lower than the positions of the propellers of the first outboard motor 3*a* and the second outboard motor 3*b*. Consequently, the third outboard motor 3*c* is less likely to be affected by bubbles from a bottom surface of the hull, which are thought to be one cause of vibration. Therefore, it is preferable for the vibration suppression control to be executed with respect to the first outboard motor 3*a* and the second outboard motor 3*b*.

Furthermore, it is acceptable for the control section 73 to execute a combination of vibration suppression controls when an occurrence of a vibration is detected. For example, it is acceptable for the control section 73 to change a toe angle and also change a trim angle or a position of an outboard motor.

The present invention is not limited to the method of detecting vibrations used by the vibration detection section 74 in the previously explained preferred embodiments. For example, it is acceptable to modify the previously explained preferred embodiments such that the vibration detecting section 74 detects a vibration when the steering angle difference exceeds the prescribed negative threshold value −A within a prescribed amount of time after the steering angle difference exceeded the prescribed positive threshold value A. In such a case, a vibration is detected at a point in time corresponding to the detection of N=2 in FIG. 5. It is also acceptable for the vibration detecting section 74 to detect a vibration when a state in which the steering angle difference exceeds the prescribed positive threshold value A and a state in which the steering angle difference exceeds the prescribed positive threshold value −A have occurred repeatedly for at least a prescribed number of times. With this approach, it is not necessary to consider the aforementioned elapsed time TM in relation to the variation of the steering angle difference shown in FIG. 5. It is also acceptable for the vibration detecting section 74 to detect a vibration when a derivative value of the actual steering angle θc larger than a prescribed threshold value. It is also acceptable for the vibration detecting section 74 to detect a vibration when a change amount of the actual steering angle θc is larger than a prescribed threshold value.

It is acceptable for the control section 73 to change the toe angle θ of the outboard motors in a toe-out direction when the vibration detecting section 74 detects a vibration.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. An outboard motor control system comprising:

a plurality of outboard motors mounted on a stern of a watercraft, each of the plurality of outboard motors including a propeller and configured to be steered independently of one another;

a vibration detecting section configured to detect a vibration of the plurality of outboard motors; and a control section configured and programmed to, when the vibration detecting section detects a vibration of the plurality of outboard motors, execute a vibration suppression control that changes at least one of a direction of a rotational axis of the propeller and a position of the propeller with respect to at least one of the plurality of outboard motors.

2. The outboard motor control system according to claim 1, wherein the control section is configured and programmed to change the direction of the rotational axis of the propeller by changing a toe angle of the plurality of outboard motors.

3. The outboard motor control system according to claim 2, wherein when the vibration detecting section detects the vibration, the control section is configured and programmed to change the toe angle of the plurality of outboard motors in a toe-in direction.

4. The outboard motor control system according to claim 2, wherein when the vibration detecting section detects the vibration, the control section is configured and programmed to change the toe angle of the plurality of outboard motors in a toe-out direction.

5. The outboard motor control system according to claim 2, wherein when the control section changes the toe angle of the plurality of outboard motors repeatedly, the control section is configured and programmed to alternate between changing the toe angle in a toe-in direction and changing the toe angle in a toe-out direction.

6. The outboard motor control system according to claim 1, further comprising:

a steering member configured to set target steering angles of the plurality of outboard motors; and a steering angle detecting section configured to detect actual steering angles of the plurality of outboard motors; wherein the vibration detecting section is configured to detect the vibration when a difference between the target steering angle and the actual steering angle of at least one of the plurality of outboard motors is larger than a prescribed value.

7. The outboard motor control system according to claim 1, further comprising:

a steering angle detecting section configured to detect actual steering angles of the plurality of outboard motors; wherein the vibration detecting section is configured to detect the vibration when a derivative value of the actual steering angle of at least one of the plurality of outboard motors is larger than a prescribed value.

8. The outboard motor control system according to claim 1, further comprising:

a steering angle detecting section configured to detect actual steering angles of the plurality of outboard motors; wherein the vibration detecting section is configured to detect a vibration when a change amount of the actual steering angle of at least one of the plurality of outboard motors is larger than a prescribed value.

9. The outboard motor control system according to claim 1, further comprising:

a steering member configured to set target steering angles of the plurality of outboard motors; and a steering angle detecting section configured to detect actual steering angles of the plurality of outboard motors; wherein the vibration detecting section is configured to detect the vibration when a difference between the target steering angle and the actual steering angle of at least one of the plurality of outboard motors exceeds a prescribed negative threshold value after a difference between the target steering angle and the actual steering angle has exceeded a prescribed positive threshold value.

10. The outboard motor control system according to claim 1, further comprising:

a steering member configured to set target steering angles of the plurality of outboard motors; and a steering angle detecting section configured to detect actual steering angles of the plurality of outboard motors; wherein the vibration detecting section is configured to detect the vibration when a difference between the target steering angle and the actual steering angle of at least one of the plurality of outboard motors exceeds a prescribed negative threshold value within a prescribed amount of time after a difference between the target steering angle and the actual steering angle has exceeded a prescribed positive threshold value.

11. The outboard motor control system according to claim 1, further comprising:

a steering member configured to set target steering angles of the plurality of outboard motors; and a steering angle detecting section configured to detect actual steering angles of the plurality of outboard motors; wherein the vibration detecting section is configured to detect the vibration when a state in which a difference between the target steering angle and the actual steering angle of at least one of the plurality of outboard motors exceeds a prescribed positive threshold value and a state in which a difference between the target steering angle and the actual steering angle exceeds a prescribed negative threshold value have occurred repeatedly at least a prescribed number of times.

12. The outboard motor control system according to claim 1, further comprising:

a steering member configured to set target steering angles of the plurality of outboard motors; and a steering angle detecting section configured to detect actual steering angles of the plurality of outboard motors; wherein the vibration detecting section is configured to detect the vibration when a change between a state in which a difference between the target steering angle and the actual steering angle of at least one of the plurality of outboard motors exceeds a prescribed positive threshold value and a state in which a difference between the target steering angle and the actual steering angle exceeds a prescribed negative threshold value has occurred within a prescribed amount of time and the change has occurred repeatedly at least a prescribed number of times.

13. The outboard motor control system according to claim 1, further comprising:

a throttle operating member configured to set a target throttle opening degree of the plurality of outboard motors; wherein the control section is configured and programmed to execute the vibration suppression control when the target throttle opening degree of at least one of the plurality of outboard motors is equal to or larger than a prescribed value and the vibration detecting section detects the vibration of the plurality of outboard motors.

14. The outboard motor control system according to claim 13, wherein when the target throttle opening degree is smaller than the prescribed value, the control section is configured and programmed to set a steering angle of the plurality of outboard motors to a default value without executing the vibration suppression control even if the vibration detecting section detects the vibration of the plurality of outboard motors.

15. The outboard motor control system according to claim 1, wherein the control section is configured and programmed to change a direction of the rotational axis of the propeller by changing a trim angle of at least one of the plurality of outboard motors.

16. The outboard motor control system according to claim 1, wherein the control section is configured and programmed to change a position of the propeller by raising or lowering the propeller.

17. The outboard motor control system according to claim 1, wherein the plurality of outboard motors include a first outboard motor arranged on a starboard side of the stern, a second outboard motor arranged on a port side of the stern, and a third outboard motor arranged between the first outboard motor and the second outboard motor.

18. The outboard motor control system according to claim 17, wherein the control section is configured and programmed to execute the vibration suppression control with respect to the first outboard motor and the second outboard motor.

19. A control method for a plurality of outboard motors mounted on a stern of a watercraft, each of the plurality of outboard motors including a propeller and being configured to be steered independently of one another, the method comprising the steps of:

detecting a vibration of the plurality of outboard motors; and executing a vibration suppression control when the vibration of the plurality of outboard motors is detected such that the vibration suppression control changes at least one of a direction of a rotational axis of the propeller and a position of the propeller with respect to at least one of the plurality of outboard motors.

* * * * *